US009505575B2

(12) United States Patent
Tsugaru et al.

(10) Patent No.: US 9,505,575 B2
(45) Date of Patent: Nov. 29, 2016

(54) NEAR-END OF ROLL DETECTING APPARATUS FOR DETECTING NEAR-END OF ROLL OF RECORDING MEDIUM, AND PRINTER

(75) Inventors: Hiroyuki Tsugaru, Saitama (JP); Gen Matsushima, Tokyo (JP); Katsutoshi Mukaijima, Tokyo (JP); Tetsuya Yamamoto, Tokyo (JP)

(73) Assignees: Citizen Holdings Co., LTD., Tokyo (JP); Citizen Systems Japan Co., LTD., Tokyo (JP)

( * ) Notice: Subject to any disclaimer, the term of this patent is extended or adjusted under 35 U.S.C. 154(b) by 1029 days.

(21) Appl. No.: 12/760,143

(22) Filed: Apr. 14, 2010

(65) Prior Publication Data

US 2010/0310294 A1 Dec. 9, 2010

(30) Foreign Application Priority Data

Jun. 8, 2009 (JP) ..... 2009-137250

(51) Int. Cl.
*B41J 15/00* (2006.01)
*B65H 26/08* (2006.01)

(52) U.S. Cl.
CPC ..... *B65H 26/08* (2013.01); *B65H 2301/41387* (2013.01); *B65H 2301/41522* (2013.01); *B65H 2511/142* (2013.01); *B65H 2511/22* (2013.01); *B65H 2801/12* (2013.01)

(58) Field of Classification Search
USPC ..... 400/901, 611, 706, 708, 613, 582, 578; 399/384; 347/104
See application file for complete search history.

(56) References Cited

U.S. PATENT DOCUMENTS

| | | | | |
|---|---|---|---|---|
| 5,566,906 | A * | 10/1996 | Kamada et al. | 242/563 |
| 8,011,844 | B2 * | 9/2011 | Yada et al. | 400/613 |
| 2007/0091159 | A1 * | 4/2007 | Chaussade et al. | 347/108 |

FOREIGN PATENT DOCUMENTS

| | | |
|---|---|---|
| JP | 62-136453 | 8/1987 |
| JP | 03-073746 | 3/1991 |
| JP | 05-016499 | 1/1993 |
| JP | 05-338335 | 12/1993 |

(Continued)

OTHER PUBLICATIONS

First Office Action of the corresponding Chinese application 201010200065.2 Issued Sep. 6, 2013.

(Continued)

*Primary Examiner* — Matthew G Marini
(74) *Attorney, Agent, or Firm* — Myers Wolin, LLC

(57) ABSTRACT

To improve precision in identifying the amount that remains of a recording medium, an apparatus includes a paper holder that supports an outer circumferential surface of a recording medium that is biased downward in a vertical direction by the weight of the recording medium, such that a position of a center of the recording medium moves on a straight-line trace, associated with consumption of the recording medium; and a light-reflecting sensor that is provided at a predetermined position at a side face of the paper holder and senses displacement per unit time at a position facing the predetermined position of the recording medium that is rotated by being pulled out of the paper holder, associated with the consumption of the recording medium, where based on the displacement sensed by the light-reflecting sensor, a radius of the recording medium at the time the light reflecting sensor senses the displacement is calculated.

8 Claims, 3 Drawing Sheets

(56) References Cited

FOREIGN PATENT DOCUMENTS

| | | |
|---|---|---|
| JP | 11308858 | 5/2001 |
| JP | 2001130808 | 5/2001 |

OTHER PUBLICATIONS

Office Action for corresponding Chinese Application No. 201010200065.2, issued Apr. 11, 2014.

* cited by examiner

NEAR-END OF ROLL DETECTING APPARATUS FOR DETECTING NEAR-END OF ROLL OF RECORDING MEDIUM, AND PRINTER

CROSS REFERENCE TO RELATED APPLICATIONS

This application is based upon and claims the benefit of priority of the prior Japanese Patent Application No. 2009-137250, filed on Jun. 8, 2009, now pending, the entire contents of which are herein wholly incorporated by reference.

BACKGROUND OF THE INVENTION

1. Field of the Invention

The present invention relates to a near-end of roll detecting apparatus that detects the amount that remains of a recording medium wound in a roll, and a printer that includes the near-end of roll detecting apparatus.

2. Description of the Related Art

Among printers that print on a recording medium that is, for example, wound in a roll is a printer that employs a so-called drop-in scheme of supporting from below, the recording medium wound in a roll and set dropped in the printer. In such a printer, the outer diameter of the recording medium wound in a roll varies with consumption of the recording medium. In such a printer, the position of the roll core portion in a center about which the recording medium is wound varies due to the weight of the recording medium and decreases in the outer diameter of the recording medium associated with consumption of the recording medium.

Conventionally, among drop-in-scheme printers is a printer that has a protrusion that engages with the roll core portion at the center of a recording medium, when the roll core portion has moved to a predetermined position, associated with consumption; and that is adapted to detect that the remaining amount of the recording medium is a predetermined amount or less, i.e., a so-called a near end by detecting the engagement of the protrusion with the roll core portion at the center of the recording medium wound in a roll.

For example, a conventional technology includes, for a paper feed roller, a unit that detects the number of rotations of a shaft and a unit that detects the number of rotations of a heat sensitive paper roll, and further detects the remaining amount of the heat sensitive paper roll by calculating the diameter of the heat sensitive paper roll from the difference between the number of rotations simultaneously detected (see, e.g., Japanese Patent Application Laid-Open Publication No. H5-16499).

As an example of a near-end of roll detecting technology, conventionally, for example, one technology includes a unit that detects a rotation time period that is necessary for a predetermined number of rotations or rotations corresponding to a predetermined angle of a roll when a rolled paper is fed being unrolled; a unit that detects the amount of the rolled paper fed when the predetermined number of rotations or the rotations corresponding to the predetermined angle of the roll is executed; and a computation processing unit that obtains paper remaining amount information by calculating the diameter of the roll at the time of the detection from the rotation time period and the amount of the rolled paper fed (see, for example, Japanese Utility Model Application Laid-Open Publication No. S62-136453).

Conventionally, for example, one approach involves calculating the rotation velocity of a roll paper fixing shaft that is a central shaft of the roll of paper being pulled out at a constant velocity, from a measurement of intervals of pulses generated using a slit plate and a sensor; comparing the temporal intervals of the pulses with a specific criterion; and, thereby, sensing the time when the roll of paper runs out (see, for example, Japanese Patent Application Laid-Open Publication No. H5-338335).

Another conventional paper remaining amount displaying scheme of displaying the remaining amount of a roll of paper that is conveyed being pressed by the roller, for example, includes a shaft rotation angle detecting unit that detects and outputs a rotation angle of a shaft of a roll of paper; a fed amount measuring unit that outputs, as the amount of paper conveyed, a rotation amount of a roller that presses and rotates the paper to be conveyed; and a remaining amount computing unit that computes and outputs the amount of paper that remains by receiving input of values output from the shaft rotation angle detecting unit and the fed amount measuring unit, respectively; where values output from the remaining amount computing unit are input to a remaining amount display unit for display (see, for example, Japanese Patent Application Laid-Open Publication No. H3-73746).

However, the conventional techniques, including the technique disclosed in Japanese Patent Application Laid-Open Publication No. H5-16499, are problematic in that although the amount that remains of a recording medium can be detected when the remaining amount becomes equal to or less than a predetermined amount, the specific amount that remains cannot be known. Therefore, for example, when a near end is reported during a busy period and printing is continued without replacement of the recording medium, an approximation of the actual amount that remains cannot be judged. Thus, a problem arises in that the recording medium runs out during the printing.

Each of the conventional technologies described in Japanese Utility Model Application Laid-Open Publication No. S62-136453, Japanese Patent Application Laid-Open Publication Nos. H5-338335 and H3-73746 is a technique of detecting the remaining amount of a recording medium when the recording medium rotates at a fixed position, that is, when the position of the center thereof is fixed. Therefore, a problem arises in that the remaining amount of the recording medium in a drop-in-scheme printer cannot be precisely reported.

To solve the problems associated with the above conventional technologies, an object of the present invention is to provide a near-end of roll detecting apparatus and a printer for a roll recording medium, that improve the precision in identifying the amount that remains of a recording medium.

SUMMARY OF THE INVENTION

To solve the problems above and achieve an object, a near-end of roll detecting apparatus for a roll of recording medium according to the present invention includes a recording medium support unit that supports an outer circumferential surface of the recording medium that is biased downward in a vertical direction by the weight of the recording medium, such that a position of a center of the recording medium moves on a straight-line trace, associated with consumption of the recording medium; a displacement sensing unit that is provided at a predetermined position at a side face of the recording medium support unit and senses displacement per unit time at a position facing the predetermined position of the recording medium that is rotated by being pulled out of the recording medium support unit, associated with the consumption of the recording medium; and a calculating unit that calculates based on the displacement sensed by the displacement sensing unit, a radius of the recording medium at the time the displacement sensing unit senses the displacement.

According to the present invention, the radius of the recording medium at the time the displacement is sensed, can be calculated accurately based on the displacement at the predetermined position of the recording medium that accompanying consumption, rotates on a recording medium support unit.

In the near-end of roll detecting apparatus above according to the present invention, the calculating unit calculates a velocity of the recording medium at the position facing the predetermined position; calculates based on the calculated velocity, a distance between the position facing the predetermined position and the position of the center; identifies based on the calculated distance and a linear equation that expresses trace of the displacement of the position of the center in a plane that at a right angle, crosses a rotation axis of the recording medium, the position of the center in the plane; and calculates based on the identified position of the center, the radius of the recording medium at the time the displacement sensing unit senses the displacement.

According to the present invention, the radius of the recording medium at the time of the sensing of the displacement may accurately be calculated by only sensing the displacement that is the fluid element, by adapting the recording medium support unit such that the position of the center of the recording medium form a straight-line trace associated with the consumption of the recording medium.

The near-end of roll detecting apparatus above according to present invention further includes a reporting unit that reports based on the radius of the recording medium calculated by the calculating unit, a remaining amount of the recording medium.

According to the present invention, the remaining amount of the recording medium that is precisely identified can be reported. Thereby, the user of the printer can know precisely the remaining amount of the recording medium.

A printer according to the present invention includes a printing unit that prints on the recording medium supplied from the recording medium support unit; and the near-end of roll detecting apparatus above.

According to the present invention, printing can be executed on a recording medium whose remaining amount is precisely determined and therefore, replacement work for the recording medium at a proper timing is aided corresponding to, for example, the relation between the remaining amount of the recording medium and the amount of printing to be executed, and the state of use of the printer (such as whether the printer is used heavily, etc.).

Thereby, an occurrence of a situation where the recording medium runs out during printing, or replacement of the recording medium is executed taking precedence over other duties during a busy period can be avoided and various kinds of work including the replacement of the recording medium can be executed efficiently.

Effect of the Invention

According to the near-end of roll detecting apparatus and a printer for a roll of recording medium according to the present invention, an effect is achieved in that the precision in identifying the remaining amount of the recording medium can be improved.

DETAILED DESCRIPTION OF THE PREFERRED EMBODIMENTS

Referring to the accompanying drawings, exemplary embodiments according to the present invention are explained in detail below.

Embodiment

Figure 1:
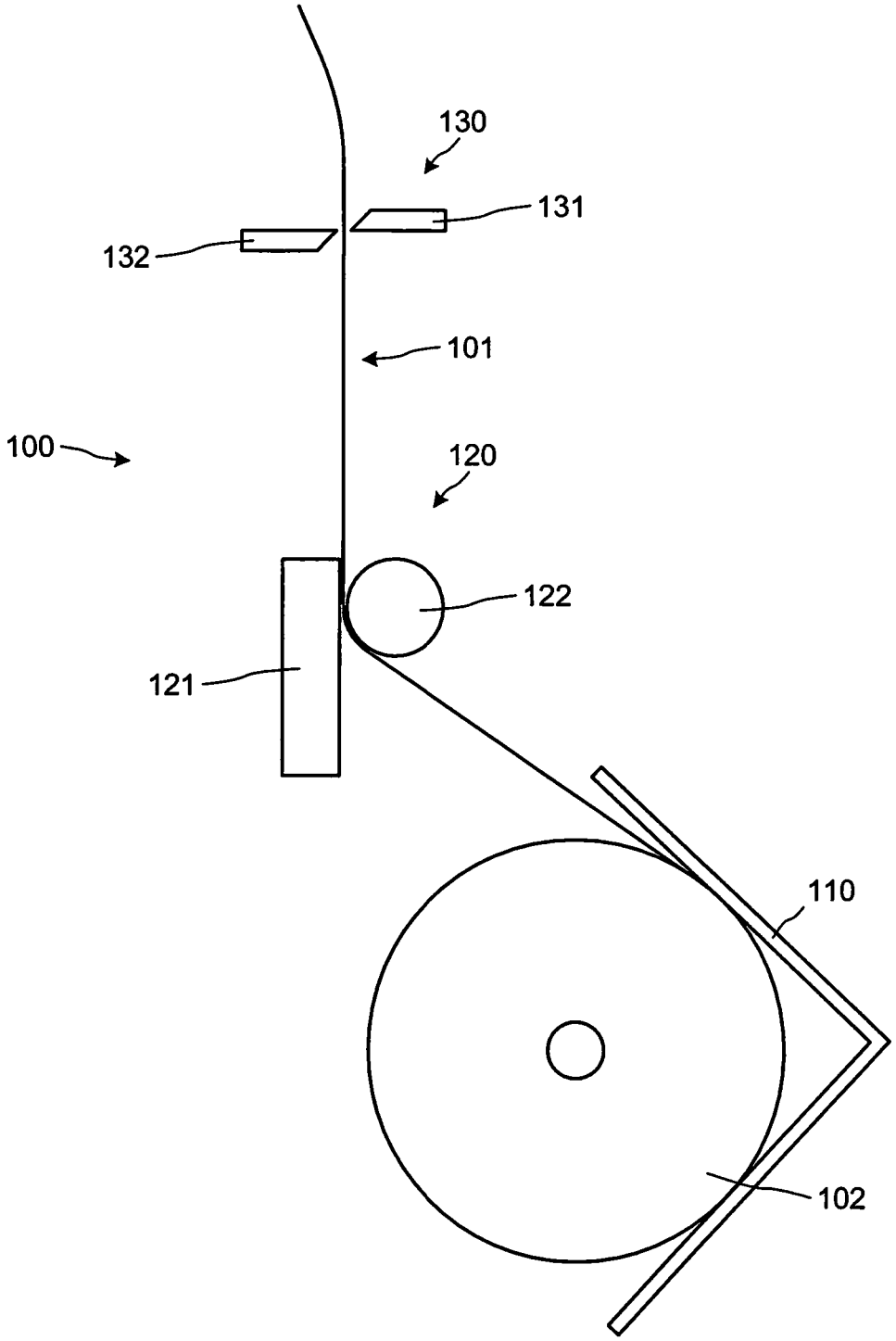
FIG. 1 is a diagram for explaining an example of a schematic configuration of a printer according to an embodiment of the present invention.

A printer apparatus according to an embodiment of the present invention will be described. FIG. 1 is a diagram for explaining an example of a schematic configuration of a printer according to the embodiment of the present invention. As depicted in FIG. 1, a printer 100 according to the embodiment of the present invention includes a paper holder 110, a printing unit 120, and a cutter unit 130.

The paper holder 110 and the printing unit 120, and the printing unit 120 and the cutter unit 130 are communicatively connected through a recording medium conveyance path 101. The paper holder 110, the printing unit 120, and the cutter unit 130 are arranged in order of the paper holder 110, the printing unit 120, and the cutter unit 130 from upstream to downstream along the recording medium conveyance path 101.

The paper holder 110 supports a recording medium 102. The recording medium 102 has a long-strip shape and forms a roll-like shape being wound from an end thereof longitudinally around a roll core. The recording medium 102 wound in a roll is supported on the paper holder 110 that is equipped in the printer 100. The paper holder 110 supports the outer circumference of the recording medium 102 wound in a roll.

The recording medium 102, which is wound in a roll and accommodated in the paper holder 110, is pulled out of the paper holder 110 from the outer circumference when the recording medium 102 is consumed for, for example, printing. Therefore, the outer diameter of the recording medium 102 wound in a roll decreases.

The paper holder 110 supports the recording medium 102 in a state where the recording medium 102 wound in a roll moves by the weight thereof and associated with the consumption of the recording medium 102. The recording medium 102 wound in a roll and supported on the paper holder 110 moves downward in a vertical direction in the paper holder 110 as the outer diameter of the recording medium 102 decreases associated with the consumption of the recording medium 102. The configuration of the paper holder 110 will be described hereinafter.

The printer 100 includes a near end detecting apparatus for a roll of recording medium (hereinafter, "near-end of roll detecting apparatus") that senses (detects) the remaining amount of the recording medium 102 wound in a roll and supported by the paper holder 110. The near-end of roll detecting apparatus includes a sensor that senses displacement per unit time on a side face of the recording medium 102 wound in a roll and accommodated in the paper holder 110, and calculates the remaining amount of the recording medium 102 based on the result of the sensing by the sensor.

Figure 2:
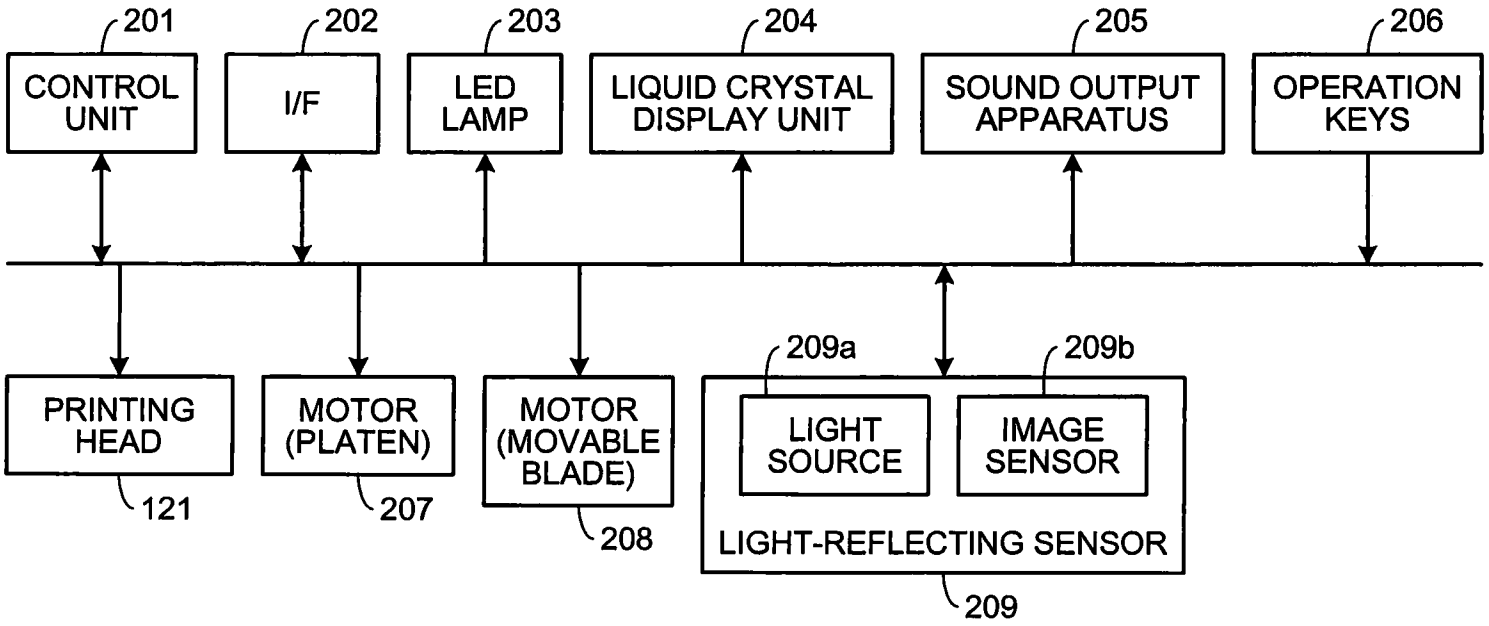
FIG. 2 is a diagram for explaining a functional configuration of the printer according to the embodiment of the present invention.

The sensor included in the near-end of roll detecting apparatus may be implemented by, for example, a light-reflecting sensor (see reference numeral "209" in FIG. 2). More specifically, a light-reflecting sensor included by the near-end of roll detecting apparatus may be configured by, for example, a light-emitting element that emits a light beam applied to the side face of the recording medium 102 wound in a roll and supported by the paper holder 110, and a light-receiving element that receives the light beam reflected from the side face of the recording medium 102. A light source (see reference numeral "209*a*" in FIG. 2) such as, for example, an LED or a laser light source may be used as the light-emitting element. More specifically, for example, an image sensor (see reference numeral "209*b*" in FIG. 2) maybe used as the light-receiving element.

The light-reflecting sensor having the above configuration applies a light beam from the light source to the side face of the recording medium 102 wound in a roll and supported by the paper holder 110, and reads a reflected light beam from the side face of the recording medium 102 using the image sensor. For the light-reflecting sensor, the temporal interval (frame rate) for the image sensor to read an image may be set for the image sensor to read the image several hundred to several thousand times per second, for example. A calculation method of calculating the remaining amount performed by the near-end of roll detecting apparatus will be described hereinafter.

The printing unit 120 prints text, etc., on the recording medium 102 conveyed from the paper holder 110. The printing unit 120 is not limited to a printing unit that prints text and may further print, for example, symbols, predetermined logo marks, and other images. A printing scheme of the printing unit 120 may be, for example, a thermal scheme.

The printing unit 120 that adopts, for example, a thermal scheme may be configured by a thermal-scheme printing head (thermal head) 121 and a platen 122. The printing head 121 and the platen 122 are disposed facing each other sandwiching the recording medium conveyance path 101 therebetween.

More specifically, the thermal-scheme printing head (thermal head) 121 includes heating elements arranged, for example, in a line along a dimension of width of the recording medium 102; selectively energizes each of the heating elements; thereby, selectively heats the heating elements; and thus, prints text, etc.

In this way, the printer 100 including the printing unit 120 that adopts a thermal scheme uses the recording medium 102 that has a heat-sensitive coloring property. The thermal-scheme printing head 121 and a control method thereof can be implemented easily using various known techniques and therefore, will not be described.

The platen 122, from a side opposite to that of the printing head 121 sandwiching the recording medium conveyance path 101 therebetween, supports the recording medium 102 to which printing pressure is applied by the printing head 121 during printing. In the embodiment, the platen 122 includes a function of conveying the recording medium 102 on which printing is executed by the printing head 121.

The platen 122, having a function of conveying the recording medium 102, may be implemented by, for example, a substantially column-shaped member whose axial dimension is along the direction of conveyance of the recording medium 102 (a direction from a side of the page of FIG. 1 that is closer to a reader, to a side on the back thereof). Such a platen 122 is coupled to a driving source such as a motor through a gear, etc., not depicted.

In the embodiment, the platen 122 is subject to and rotated by a driving force transmitted from a motor (see reference numeral "207" in FIG. 2) for the platen and thereby, conveys the recording medium 102. The function of conveying the recording medium 102 is not limited to a function provided to the platen 122, and one or multiple conveying roller(s) may be provided along the recording medium conveyance path 101 and the function may be implemented by the conveying roller(s).

In the recording medium conveyance path 101, the cutter unit 130 cuts at an arbitrary length, the recording medium 102 that has passed the printing unit 120, downstream from the printing unit 120 in the direction of the conveyance of the recording medium 102. The cutter unit 130 includes a fixed blade 131 and a movable blade 132. The position of the fixed blade 131 is fixed. The movable blade 132 is provided at a position at which the movable blade 132 faces the fixed blade 131 sandwiching the recording medium conveyance path 101 therebetween. The movable blade 132 is movable in directions moving the movable blade 132 toward and away from the fixed blade 131.

The cutter unit 130 includes a driving source such as a motor for the movable blade (see reference numeral "208" in FIG. 2); a power transmitting mechanism (not depicted) that transmits the driving force generated by the motor, to the movable blade 132; etc. When the recording medium 102 is positioned between the fixed blade 131 and the movable blade 132, the cutter unit 130 cuts the recording medium 102 that is positioned between the fixed blade 131 and the movable blade 132 by moving the movable blade 132 close to the fixed blade 131, using the driving force generated by the motor. Thereby, the recording medium 102 on which printing has been executed by the printing unit 120 may be cut at an arbitrary length.

After cutting the recording medium 102, the cutter unit 130, using the driving force that the motor generates, moves the movable blade 132 in the direction for moving the movable blade 132 away from the fixed blade 131 and thereby, forms a gap between the fixed blade 131 and the movable blade 132. By rotating the platen 122 in this state, the recording medium 102 supported by the paper holder 110 is fed being unrolled in the downstream direction in the recording medium conveyance path 101; thereby, making the printer ready for the next printing.

The printer 100 is accommodated in a non-depicted casing. The casing may be configured by, for example, a casing main body having a box shape, a printer cover that closes an opening of the casing main body, etc. For replenishing or replacing the recording medium 102, the printer cover of the casing can be opened and closed such that the opening of the casing main body is opened and the paper holder 110 in the printer 100 is in a state where the recording medium 102 can be replenished or replaced.

The casing may be provided with a locking releasing lever, etc., that releases an engagement in a locking mechanism when a user of the printer 100, etc., operates the locking releasing lever. The casing may be adapted to open the paper holder 110 to the exterior when, for example, the locking releasing lever is operated and the engagement in the locking mechanism is released.

When the printer cover is moved in the direction for the printer cover to open and the paper holder 110 is opened to the exterior, the recording medium 102 wound in a roll may be accommodated in the paper holder 110, the recording medium 102 accommodated in the paper holder 110 may be taken out of the paper holder 110, etc. The locking releasing lever is operated when, for example, the remaining amount of the recording medium 102 accommodated in the paper holder 110 becomes small and a new recording medium 102 is to be set.

The casing may be equipped with, for example, an operation panel not depicted. The operation panel may be configured with, for example, operation keys that receive various types of operations with respect to the printer 100 (see reference numeral "206" in FIG. 2), an LED lamp that indicates the state of the printer 100 (see reference numeral "203" in FIG. 2), and a liquid crystal display unit that indicates the state of the printer 100 using text or symbols (see reference numeral "204" in FIG. 2). The casing may also be equipped with a power switch that switches the power of the printer 100 between ON and OFF, etc.

More specifically, the LED lamp is lit or flashed, for example, when the power of the printer 100 is turned on and the printer 100 is in a printing standby state, when an error occurs in the printer 100, or when the remaining amount of the recording medium 102 in the printer 100 becomes a predetermined amount or less. The liquid crystal display unit displays information to report each of the following states of the printer 100: a printing standby state, a malfunction state, a state when the remaining amount of the recording medium 102 becomes the predetermined amount or less, etc.

The printer 100 may also include a sound output apparatus that outputs predetermined sounds (see reference numeral "205" in FIG. 2). The sound output apparatus reports each of the following states by outputting audio guidance or a warning sound: a malfunction state, a state when the remaining amount of the recording medium 102 in the printer 100 becomes a predetermined amount or less, etc.

More specifically, the sound output apparatus may be implemented by, for example, a speaker. Alternatively, more specifically, the sound output apparatus may be implemented by, for example, a buzzer. The sound output apparatus may be implemented easily using various known techniques and therefore, will not be described.

In the above printer 100, the recording medium 102 wound in a roll and accommodated by the paper holder 110 is pulled out from the outer circumference thereof by the platen 122 that rotates to feed the recording medium 102, unrolling the recording medium 102 from the paper holder 110 toward the printing unit 120 to supply the recording medium 102 to the printing unit 120.

The recording medium 102 wound in a roll is pulled out from the outer circumference thereof and thereby, is rotated in the paper holder 110 reducing the outer diameter of the recording medium 102. The recording medium 102 wound in a roll is biased downward in the vertical direction by the weight thereof, in the paper holder 110 and therefore, the position of the shaft around which the recording medium 102 is wound, i.e., the position of the center of the recording medium 102 moves downward associated with the decrease in the outer diameter.

The paper holder 110 supports the recording medium 102 wound in a roll such that the position of the center of the recording medium 102 moves on a straight-line trace, associated with the consumption of the recording medium 102. The light-reflecting sensor included in the near-end of roll detecting apparatus is attached at a position at which the light-reflecting sensor can read an image of the recording medium 102 until the recording medium 102 in the paper holder 110 runs out.

The position of the light-reflecting sensor included by the near-end of roll detecting apparatus is not limited to the position at which the light-reflecting sensor reads the image of the recording medium 102 until the recording medium 102 in the paper holder 110 completely runs out. More specifically, the position of the light-reflecting sensor included by the near-end of roll detecting apparatus may also be a position at which the light-reflecting sensor can read the image of the recording medium 102 until the length of the recording medium 102 becomes a predetermined length or less such as, for example, a length with which the recording medium 102 cannot maintain a roll shape, a length that is not suitable for printing, etc.

The near-end of roll detecting apparatus applies a light beam from a LED or a laser light source to the side face of the recording medium 102 wound in a roll and supported by the paper holder 110; reads a reflected light beam from the side face of the recording medium 102 using an image sensor; and calculates displacement in an X-axis direction and a Y-axis direction. A calculation method of the displacement, for example, involves images each read by the image sensor at a predetermined time interval being compared with each other; the latest image read and an immediately previous image read being compared with each other; common portions included in the images being detected; and calculating the extent which the common portions in the latest image read have shifted relative to the common portions in the immediately previous image read.

In the embodiment, each of temporal intervals (frame rate) for the image sensor to read the images is a temporal interval at which the above common portions are included in both of the latest image read and the immediately previous image read when the recording medium 102 is rotated at the highest velocity thereof associated with the consumption of the recording medium 102. Thereby, the detection of the remaining amount of the recording medium 102 can be executed precisely.

Concerning the temporal interval (frame rate) for the image sensor to read the images, precision in sensing displacement of the recording medium 102 per unit time increases as the number of times of reading per second increases. The structure of the sensor and a method of sensing the displacement per unit time of the recording medium 102 by the sensor are the same as, for example, the structure and the method of sensing according to calculation of a displacement of an optical mouse and therefore, will not be described.

(Functional Configuration of Printer 100)

A functional configuration of the printer 100 according to the embodiment of the present invention will be described. FIG. 2 is a diagram for explaining a functional configuration of the printer 100 according to the embodiment of the present invention. As depicted in FIG. 2, the printer 100 according to the embodiment of the present invention includes a control unit 201, an interface (I/F) 202, an LED lamp 203, a liquid crystal display unit 204, a sound output apparatus 205, operation keys 206, a motor 207 for the platen, a motor 208 for the movable blade, a light-reflecting sensor 209, and the printing head 121.

The control unit 201 governs overall control of the printer 100. The control unit 201 may be implemented by, for example, a micro computer configured by a CPU, a ROM, a RAM, etc., and governs overall the control of the printer 100 by using the CPU to execute a program stored in the ROM, with the RAM being used as a work area of the CPU. The I/F 202 is connected to an external apparatus such as a POS terminal, administers interface between an external apparatus such as a POS terminal and the printer 100, and controls the input and output of data to/from the printer 100.

More specifically, for example, the printer 100 receives printing data from an external apparatus such as a POS terminal through the I/F 202 and executes a printing operation by controlling the components using the control unit 201, based on the received printing data. More specifically, for example, when an error occurs in the printer 100, the printer 100 outputs to an external apparatus such as a POS terminal through the I/F 202, an error signal indicating that an error has occurred.

The LED lamp 203 is lit or flashed by being controlled by the control unit 210. More specifically, the LED lamp 203 is lit or flashed, for example, when the power of the printer 100 is turned on and the printer 100 is in a printing standby state, when an error occurs in the printer 100, or when the remaining amount of the recording medium 102 in the printer 100 becomes a predetermined amount or less. In the embodiment, the LED lamp 203 may implement a reporting unit.

The liquid crystal display unit 204 displays text, symbols, etc., under the control of the control unit 201. More specifically, the liquid crystal display unit 204 displays text information, etc. reporting the following states of the printer 100, for example, a printing standby state as above, a malfunction state, a state when the remaining amount of the recording medium 102 becomes a predetermined amount or less, etc. In the embodiment, the liquid crystal display unit 204 may implement the reporting unit.

The sound output apparatus 205 outputs predetermined sounds under the control of the control unit 201. More specifically, the sound output apparatus 205 outputs audio guidance or a warning sound, for example, when an error occurs in the printer 100 as above, when the remaining amount of the recording medium 102 in the printer 100 becomes a predetermined amount or less, etc. In the embodiment, the sound output apparatus 205 may implement the reporting unit.

The printer 100 is not limited to a printer that includes all of the LED lamp 203, the liquid crystal display unit 204, and the sound output apparatus 205 that each realize the reporting unit, and may be a printer that includes one or more among the LED lamp 203, the liquid crystal display unit 204, and the sound output apparatus 205. The printer 100 may also be adapted to output to an external apparatus such as a POS terminal through the I/F 202, a signal that indicates that the remaining amount of the recording medium 102 in the printer 100 has become a predetermined amount or less, and cause the external apparatus to output notification that the remaining amount of the recording medium 102 in the printer 100 is the predetermined amount or less, when the remaining amount of the recording medium 102 in the printer 100 becomes a predetermined amount or less.

The operation keys 206 are provided and output to the control unit 201, signals that correspond to the keys operated. The motor 207 for the platen and the motor 208 for the movable blade are controlled by the control unit 201 and each act at a predetermined timing.

The light-reflecting sensor 209 includes a light source 209*a* and an image sensor 209*b*. The light source 209*a* applies a light beam to the side face of the recording medium 102 wound in a roll and supported by the paper holder 110. The image sensor 209*b* reads an image at a point to which the light beam is applied by the light source 209*a* at the side face of the recording medium 102, and outputs the image data read to the control unit 201.

The control unit 201 calculates (senses) displacement per unit time at a position on the roll recording medium 102 supported by the paper holder 110 and to be read by the image sensor 209*b*, based on the image data output from the light-reflecting sensor 209. In the embodiment, the light-reflecting sensor 209 and the control unit 201 may implement a displacement sensing unit.

Based on the displacement calculated, the control unit 201 calculates the radius of the roll recording medium 102 supported by the paper holder 110 at the time when the image sensor 209*b* reads the image. In the embodiment, the control unit 201 may implement a function of a calculating unit.

Thus, in the embodiment, the light-reflecting sensor 209 and the control unit 201 may implement the near-end of roll detecting apparatus. The control unit 201 may further calculate the remaining amount of the recording medium 102 in the paper holder 110 based on the radius of the roll of the recording medium 102 supported by the paper holder 110.

(Calculation Method of Remaining Amount)

Figure 3:
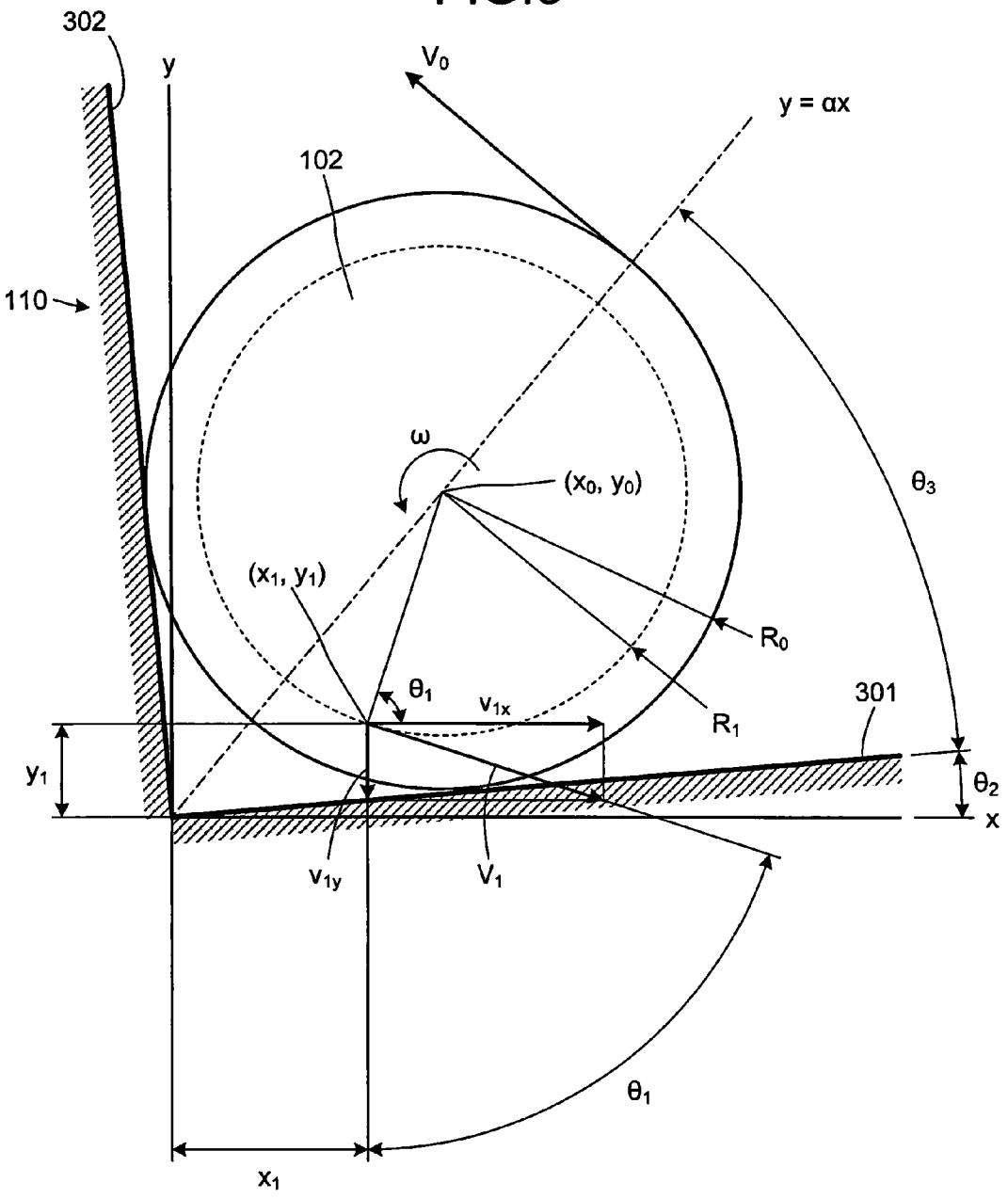
FIG. 3 is a diagram for explaining a calculation method of the remaining amount of recording medium in the printer according to the embodiment of the present invention.

A calculation method of the remaining amount of the recording medium 102 in the printer 100 according to the embodiment will be described. FIG. 3 is a diagram for explaining a calculation method of the remaining amount of the recording medium 102 in the printer 100 according to the embodiment of the present invention.

As depicted in FIG. 3, the recording medium 102 wound in a roll and accommodated in the paper holder 110, the recording medium support unit, is moved toward a point at coordinates (0, 0) in an X-Y coordinate system as the outer diameter there of becomes smaller associated with the consumption the recording medium 102. In the embodiment, for example, the X-axis direction is described assuming this direction to be parallel to the horizontal direction and the Y-axis direction is described assuming this direction to be parallel to the vertical direction.

A bottom face 301 of the paper holder 110 is implemented by a plane that extends in a direction that is a positive direction in each of the X-axis direction and the Y-axis direction from the point at the coordinates (0, 0), with this point at the coordinates (0, 0) as a starting point. More specifically, the bottom face 301 of the paper holder 110 is implemented by a plane that is inclined by an angle $\theta_2$ relative to the X axis from the point at the coordinates (0, 0), with the point at the coordinates (0, 0) as the starting point.

In the paper holder 110, a wall face 302 that supports the outer circumference face of the roll recording medium 102 from a lateral direction is implemented by a plane that extends in a direction that is the positive direction in the Y-axis direction from the point at the coordinates (0, 0), with the point at the coordinates (0, 0) as a starting point. The wall face 302 of the paper holder 110 in the embodiment extends in a direction that is a negative direction from the point at the coordinates (0, 0) in the X-axis direction.

The bottom face 301 and the wall face 302 of the paper holder 110 are shaped to support the roll recording medium 102 such that the position of the center of the recording medium 102 wound in a roll moves on a straight line trace, associated with the consumption of the recording medium 102. More specifically, the bottom face 301 and the wall face 302 of the paper holder 110 in the embodiment are shaped to support the roll recording medium 102 such that the position of the center of the roll recording medium 102 moves on a straight line that is inclined relative to the X axis by an angle $(\theta_2+\theta_3)$ passing through the point at the coordinates (0, 0), associated with the consumption the roll recording medium 102.

For FIG. 3, description is given taking an example of the shape of the wall face 302 of the paper holder 110 that extends in the direction that is the negative direction from the point at the coordinates (0, 0) in the X-axis direction. However, the shape of the wall face 302 of the paper holder 110 is not limited hereto when the wall face 302 is shaped to support the roll recording medium 102 such that the position of the center of the roll recording medium 102 moves on the straight line trace, associated with the consumption of the recording medium 102. More specifically, the shape of the wall face 302 of the paper holder 110 is not limited to the shape that extends in the direction that is the negative direction from the point at the coordinates (0, 0) in the X-axis direction, and may be a shape that extends in a direction that is the positive direction in the X-axis direction.

The light-reflecting sensor 209 included by the near-end of roll detecting apparatus is disposed at a position at which the light-reflecting sensor 209 can sense the displacement per unit time of the roll of paper at a point at coordinates $(x_1, y_1)$. More specifically, when the displacement per unit time of the roll of paper is sensed using the light-reflecting sensor 209, the image sensor 209*b* in the light-reflecting sensor 209 is disposed at a position at which the image sensor 209*b* can read a portion of the image at the point at the coordinates $(x_1, y_1)$ of the side face of the roll recording medium 102.

The roll recording medium 102 that the paper holder 110 supports is rotated at an angular velocity ω centering a point at coordinates $(x_0, y_0)$ that is the center of the winding of the roll recording medium 102, associated with consumption thereof. When the center of the winding is located at the point at the coordinates $(x_0, y_0)$, the radius of the roll recording medium 102 is denoted by "$R_0$" and the length from the point at the coordinates $(x_0, y_0)$ to the point at the coordinates $(x_1, y_1)$ is denoted by "$R_1$".

The near-end of roll detecting apparatus first compares the latest image read with the immediately previous image read and thereby, detects the common portions included in the images and calculates the extent to which the common portions in the latest image read have shifted relative to the common portions in the immediately previous image read. Thereby, the displacement per unit time at an arbitrary radius $R_0$ may be identified.

More specifically, displacement in the X-axis direction and displacement in the Y-axis direction per unit time are identified by the light-reflecting sensor 209 that the near-end of roll detecting apparatus includes. By dividing the identified displacement by a measurement interval time period (frame rate), a component $v_{1x}$ in the X-axis direction and a component $y_{1y}$ in the Y-axis direction of a velocity $V_1$ of the roll recording medium 102 at the point at the coordinates $(x_1, y_1)$ are calculated.

In this case, the bottom face 301 of the paper holder 110 is inclined by the angle $\theta_2$ relative to the X-axis direction and the paper holder 110 supports the roll recording medium 102 such that the roll recording medium 102 moves on a straight line that is inclined by the angle $(\theta_2+\theta_3)$ relative to the X axis. Therefore, the position of the center of the roll recording medium 102 is on a straight line expressed by an equation, $y=\tan(\theta_2+\theta_3)x$. Representing "$\tan(\theta_2+\theta_3)$" as a constant "α" because $\tan(\theta_2+\theta_3)$ is constant, the position of the center of the roll recording medium 102 is on a linear straight line that is expressed by an equation, $y=\alpha x$.

When the position to be read by the light-reflecting sensor 209 is at the point at the coordinates $(x_1, y_1)$, the radius of the roll recording medium 102 is $R_0$, and the winding center position of the roll recording medium 102 is at the point at the coordinates $(x_0, y_0)$, representing the length from the point at the coordinates $(x_0, y_0)$ to the point at the coordinates $(x_1, y_1)$ as $R_1$, the angular velocity ω of the roll recording medium 102 and a velocity $V_0$ of the roll recording medium 102 at the outer surface thereof can be expressed by equation (1) below.

$$R_0\omega=V_0 \tag{1}$$

The velocity $V_0$ is equal to the velocity of the recording medium 102 being pulled out of the paper holder 110 by the rotation of the platen 122 in the printing unit 120. The velocity $V_0$ is a known value for the printer 100.

Representing the velocity $V_1$ of the roll recording medium 102 at the position to be read by the light-reflecting sensor 209 as $V_1=\sqrt{((v_{1x})^2+(v_{1y})^2)}$ using $(v_{1x}, v_{1y})$ in FIG. 3, equation (2) below holds.

$$R_1\omega=V_1 \tag{2}$$

Representing an angle formed by $V_1$ and $v_{1y}$ in FIG. 3 as $\theta_1$, an angle formed by a straight line drawn from the point at the coordinates $(x_0, y_0)$ to the point at the coordinates $(x_1, y_1)$ and the X axis is also $\theta_1$. Thereby, equations (3) and (4) below hold.

$$R_1 \sin\theta_1+y_1=y_0 \tag{3}$$

$$x_1+R_1 \cos\theta_1=x_0 \tag{4}$$

The relation between $V_1$, $v_{1x}$, and $v_{1y}$ may be expressed by equations (5) and (6) below using the angle $\theta_1$.

$$V_1 \sin\theta_1=v_{1x} \tag{5}$$

$$V_1 \cos\theta_1=v_{1y} \tag{6}$$

From equations (1) and (2), equation (7) below holds.

$$R_0=(V_0/V_1)R_1 \tag{7}$$

The position of the center of the roll recording medium 102 moves on a straight line, "$y=\tan(\theta_2+\theta_3)x$" and, therefore, equation (8) below holds when the position of the center of the roll recording medium 102 is at the coordinates $(x_0, y_0)$.

$$y_0=\alpha x_0=\tan(\theta_2+\theta_3)x_0 \tag{8}$$

Equation (9) below holds from equations (5), (6), and (8).

$$R_1=(\alpha x_1-y_1)/(\sin\theta_1-\cos\theta_1) \tag{9}$$

Equation (10) below holds from equations (5), (6), (7), and (9).

$$R_0=\{V_0(\alpha x_1-y_1)\}/(v_{1x}+\alpha v_{1y}) \tag{10}$$

The outer diameter of the roll recording medium 102 supported by the paper holder 110 can be precisely calculated according to the above method. The remaining amount of the recording medium 102 can be estimated based on the outer diameter of the recording medium 102 and therefore, precision in the estimation of the remaining amount of the recording medium 102 can be improved by facilitating improvement of the precision in the calculation of the outer diameter of the recording medium 102.

The outer diameter of the roll recording medium 102 supported by the paper holder 110 is calculated according to the above method and thereby, the calculation of the outer diameter dimension of the recording medium 102 can be executed at an arbitrary timing. The remaining amount of the recording medium 102, which is precisely estimated at an arbitrary timing, is reported and thereby, meticulous notification of the remaining amount of the recording medium 102 is provided to a user of the printer 100.

As described, the near-end of roll detecting apparatus of the embodiment characteristically includes the paper holder 110 as an example of the recording medium support unit that supports the outer circumferential surface of the roll of the recording medium 102 that is biased downward in the vertical direction by the weight thereof, such that the position of the center of the recording medium 102 moves on a straight line trace, associated with the consumption of the recording medium 102; the light-reflecting sensor 209 as an example of the displacement sensing unit that is disposed at a predetermined position at the side face of the paper holder 110 and that senses the displacement per unit time at the position facing a predetermined position (the point at the coordinates $(x_1, y_1)$ in the embodiment) of the recording medium 102 that is rotated by being pulled out of the paper holder 110, associated with the consumption of the recording medium 102; and the control unit 201 as an example of the calculating unit that calculates the radius of the recording medium 102 at the time of the sensing by the light-reflecting sensor 209, based on the displacement sensed by the light-reflecting sensor 209.

According to the near-end of roll detecting apparatus of the embodiment, the radius of the recording medium 102 at the time of the sensing of the displacement can be accurately calculated, based on the displacement at the point at the coordinates $(x_1, y_1)$ of the recording medium 102 rotated in the paper holder 110, associated with consumption.

According to the near-end of roll detecting apparatus of the embodiment, in both of the cases where the velocity $V_0$ of the outer circumferential surface of the roll recording medium 102 in the paper holder 110, i.e., the velocity of the recording medium 102 being pulled out from the paper holder 110 is constant and where the velocity suitably varies, the displacement at the point at the coordinates $(x_1, y_1)$ of the recording medium 102 rotated in the paper holder 110 can be sensed accurately each time the displacement is sensed by the light-reflecting sensor 209. Thereby, the radius of the recording medium 102 at the time of the sensing of the displacement can be calculated accurately regardless of whether the velocity $V_0$ is constant.

According to the near-end of roll detecting apparatus of the embodiment, the radius of the recording medium 102 at the time of the sensing of the displacement at the point at the coordinates $(x_1, y_1)$ by the light-reflecting sensor 209 can be calculated accurately and therefore, the precision in identifying the remaining amount of the recording medium 102 can be improved.

The near-end of roll detecting apparatus of the embodiment is characterized in that the control unit 201 calculates the velocity of the recording medium 102 at the position that faces the point at coordinates $(x_1, y_1)$; based on the velocity calculated, calculates the distance $R_1$ between the position that faces the point at the coordinates $(x_1, y_1)$ and a point at the coordinates $(x_0, y_0)$ that is the position of the center; based on the distance $R_1$ calculated and the linear equation that expresses the trace of the movement of the point at the coordinates $(x_0, y_0)$ that is the position of the center in the plane that crosses at a right angle, the rotation axis of the recording medium 102, identifies the coordinates $(x_0, y_0)$ of the position of the center in the plane identified by the X-Y coordinate system; and based on the coordinates $(x_0, y_0)$ of the position of the center identified, calculates the radius of the recording medium 102 at the time of the sensing by the light-reflecting sensor 209.

According to the near-end of roll detecting apparatus of the embodiment, the radius of the recording medium 102 at the time of the sensing of the displacement can be calculated accurately by merely sensing the displacement by adapting the paper holder 110 to support the recording medium 102 such that the position of the center of the recording medium 102 draws a straight line trace associated with the consumption of the recording medium 102.

The near-end of roll detecting apparatus of the embodiment characteristically includes the liquid crystal display unit 204 and the sound output apparatus 205 as examples of the reporting unit that report the remaining amount of the recording medium 102, based on the radius of the recording medium 102 calculated by the control unit 201.

According to the near-end of roll detecting apparatus of the embodiment, the remaining amount of the recording medium 102 that is precisely identified can be reported. Thereby, the user of the printer 100 can know precisely the remaining amount of the recording medium 102.

The printer 100 of the embodiment characteristically includes the printing unit 120 that prints on the recording medium 102 supplied from the paper holder 110, and the near-end of roll detecting apparatus for the above roll recording medium 102.

According to the printer 100 of the embodiment, printing can be executed on the recording medium 102 whose remaining amount is precisely determined and therefore, work for replacing the roll recording medium 102 can be aided to enable execution at a proper timing corresponding to, for example, the relation between the remaining amount of the recording medium 102 and the amount of printing to be executed, and usage state of the printer 100 (such as whether the printer is used heavily).

Thereby, an occurrence of a situation where the recording medium 102 runs out during printing, or replacement of the recording medium 102 taking precedence over other duties during a busy period are avoided.

More specifically, for example, when the recording medium 102 runs out during printing, the printing is re-executed or the time period for completing the printing work becomes longer than usual by re-executing the printing and thereby, overall work efficiency including the printing work is degraded.

More specifically, for example, in a case where replacement work for the recording medium 102 is executed taking the precedence over other duties during a busy period to avoid a shortage of the recording medium 102 during printing because the precise amount remaining of the recording medium 102 is unknown even when the remaining amount of the recording medium 102 is sufficient for the amount of printing to be executed, the time consumed to complete the printing work is contrarily extended because the replacement work is executed at a non-urgent timing. Thereby, overall work efficiency including the printing work is degraded.

In contrast, according to the printer 100 of the embodiment, the replacement work of the roll recording medium 102 can be executed at a proper timing and therefore, degradation of overall work efficiency including the printing work due to the execution of the replacement of the recording medium 102 is prevented.

INDUSTRIAL APPLICATION

As described, the near-end of roll detecting apparatus and the printer for a roll recording medium according to the present invention are useful for a near-end of roll detecting apparatus for a recording medium wound in a roll, to detect the remaining amount of the roll recording medium and a printer including the near-end of roll detecting apparatus for the roll recording medium; and especially, for a near-end of roll detecting apparatus for a recording medium wound in a roll with respect to which detection precision at an arbitrary timing is demanded concerning the remaining amount of the roll recording medium and a printer including the near-end of roll detecting apparatus for the roll recording medium.

What is claimed is:

1. A near-end of roll detecting apparatus for a roll of recording medium, comprising:

a recording medium support unit that supports an outer circumferential surface of the recording medium that is biased downward in a vertical direction by the weight of the recording medium, such that a position of a center of the recording medium moves on a straight-line trace, associated with consumption of the recording medium;

a displacement sensing unit that is provided at a position facing a predetermined position at a side face of the recording medium and senses displacement per unit time at the predetermined position at the side face of the recording medium when the recording medium is rotated by being pulled out of the recording medium support unit, associated with the consumption of the recording medium, wherein the rotational axis of the roll is perpendicular to the side face; and a calculating unit that calculates based on the displacement sensed by the displacement sensing unit, a radius of the recording medium at the time the displacement sensing unit senses the displacement.

2. The near-end of roll detecting apparatus according to claim 1, wherein the calculating unit calculates a velocity of the recording medium at the position facing the predetermined position; calculates based on the calculated velocity, a distance between the position facing the predetermined position and the position of the center; identifies based on the calculated distance and a linear equation that expresses trace of the displacement of the position of the center in a plane that at a right angle, crosses a rotation axis of the recording medium, the position of the center in the plane; and calculates based on the identified position of the center, the radius of the recording medium at the time the displacement sensing unit senses the displacement.

3. The near-end of roll detecting apparatus according to claim 1, further comprising a reporting unit that reports based on the radius of the recording medium calculated by the calculating unit, a remaining amount of the recording medium.

4. A printer comprising:

a printing unit that prints on the recording medium supplied from the recording medium support unit; and the near-end of roll detecting apparatus according to claim 1.

5. A printer comprising:

a printing unit that prints on the recording medium supplied from the recording medium support unit; and the near-end of roll detecting apparatus according to claim 3.

6. A printer comprising:

a printing unit that prints on the recording medium supplied from the recording medium support unit; and the near-end of roll detecting apparatus according to claim 2.

7. The near-end of roll detecting apparatus according to claim 2, further comprising a reporting unit that reports based on the radius of the recording medium calculated by the calculating unit, a remaining amount of the recording medium.

8. A printer comprising:

a printing unit that prints on the recording medium supplied from the recording medium support unit; and the near-end of roll detecting apparatus according to claim 7.

* * * * *